US007181951B1

(12) United States Patent
Schmidt

(10) Patent No.: US 7,181,951 B1
(45) Date of Patent: Feb. 27, 2007

(54) DENT REMOVAL DEVICE AND METHOD

(76) Inventor: Michael J. Schmidt, 3048 W. 96th Pl., Evergreen Park, IL (US) 60805

( * ) Notice: Subject to any disclaimer, the term of this patent is extended or adjusted under 35 U.S.C. 154(b) by 0 days.

(21) Appl. No.: 11/188,997

(22) Filed: Jul. 25, 2005

(51) Int. Cl.
*B21J 13/08* (2006.01)

(52) U.S. Cl. ..... 72/458; 72/309; 72/454; 72/705

(58) Field of Classification Search ..... 72/308, 72/309, 422, 454, 456, 457, 458, 465.1, 479, 72/705; 254/93 R, 93 A, 124, 131
See application file for complete search history.

(56) References Cited

U.S. PATENT DOCUMENTS 3,061,351 A * 10/1962 Johnson ..... 294/64.1
3,272,549 A * 9/1966 Nisula ..... 294/64.1
3,584,836 A * 6/1971 Brubaker, Sr. ..... 254/124
3,712,106 A * 1/1973 Holsapple et al. ..... 72/309
3,728,891 A * 4/1973 Hall, Jr. ..... 72/465.1
3,779,057 A * 12/1973 Sonnenberg ..... 72/56
4,351,518 A * 9/1982 Stievenart ..... 271/90
5,381,990 A * 1/1995 Belokin et al. ..... 248/205.9
6,502,794 B1 * 1/2003 Ting ..... 248/206.2

OTHER PUBLICATIONS

Heavy Duty Dual Suction Cup Professional Item No. 46134. Illustration of prior art Suction Cup.

* cited by examiner

*Primary Examiner*—Ed Tolan
(74) *Attorney, Agent, or Firm*—Schiff Hardin LLP

(57) ABSTRACT

In a system and method for removing a dent from an automotive vehicle body surface, first and second suction elements are each formed of a flexible disc, a support disc, and a pull stud attached to the support disc. A releasable lever engagement member is provided at an end of the pull stud. Each flexible disc has a vehicle body facing surface which is continuous without air exits. The first and second suction elements are placed on the vehicle surface, with at least one of the suction elements at the dent. A lever bar is inserted through the releasable lever engagement members at ends of the respective pull studs where it is loosely retained.

30 Claims, 2 Drawing Sheets

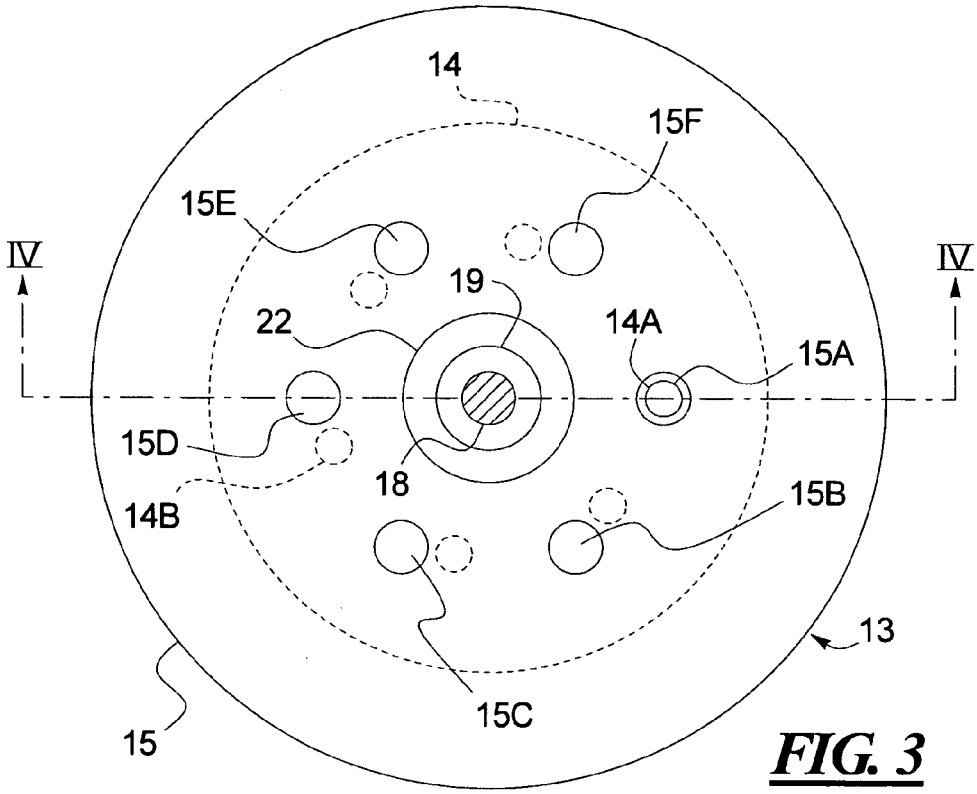
FIG. 3
FIG. 4
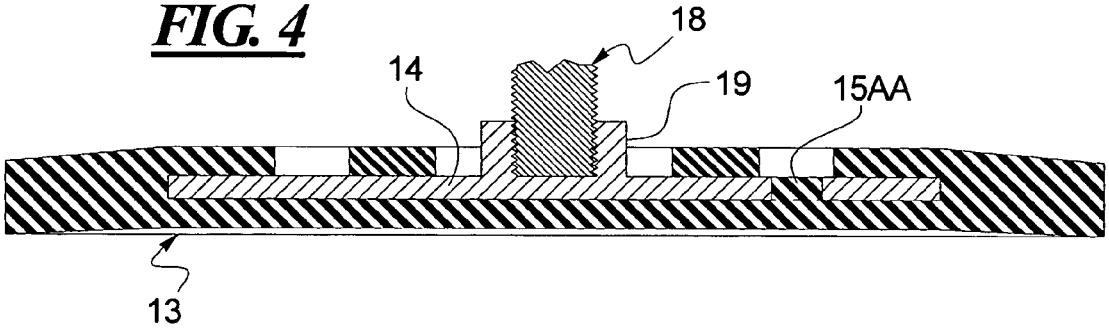
FIG. 5
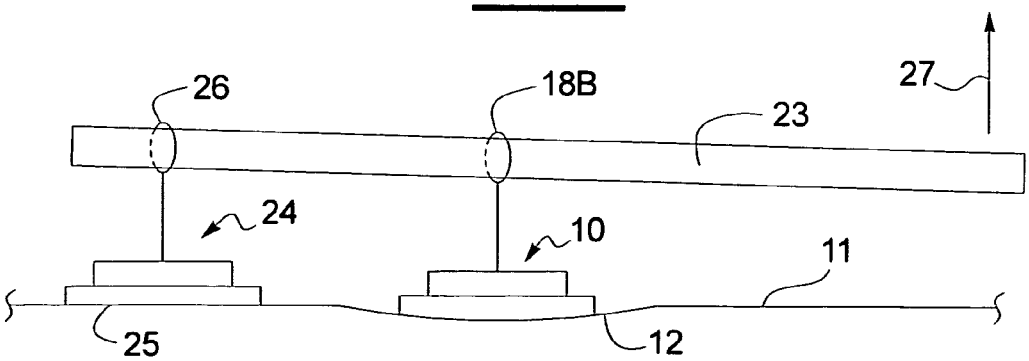

DENT REMOVAL DEVICE AND METHOD

BACKGROUND

When removing dents from an automotive vehicle metal or plastic body surface, it is known to drill a hole at a region of the dent and pull the dent out by inserting a pulling member, which engages through the hole. Alternatively, it is known to weld an attachment element at the region of the dent and then attach a pulling member to the attachment element to pull out the dent.

A disadvantage of such prior art techniques is the necessity to drill a hole or attach the attachment element in the region of the dent. Also such techniques are not practical typically for the owner of an automotive vehicle who would not have the appropriate equipment available nor the ability to cover up or repair the hole or area where the attachment element is attached at the dent.

SUMMARY

It is an object to provide an improved dent removal device and method.

In a system and method for removing a dent from an automotive vehicle body surface, first and second suction elements are each formed of a flexible disc, a support disc, and a pull stud attached to the support disc. A releasable lever engagement member is provided at an end of the pull stud. Each flexible disc has a vehicle body facing surface which is continuous without air exits. The first and second suction elements are placed on the vehicle surface, with at least one of the suction elements at the dent. A lever bar is inserted through the releasable lever engagement members at ends of the respective pull studs where it is loosely retained.

BRIEF DESCRIPTION OF THE DRAWINGS

FIG. 3 is a top view of a suction element of the dent removal device of FIG. 1;

FIG. 4 is an enlarged cross-sectional view taken along line IV—IV of FIG. 3 of the suction element; and FIG. 5 is a side view of a lever system used with the dent removal device of FIG. 1.

DESCRIPTION OF THE PREFERRED EMBODIMENTS

Figure 1:
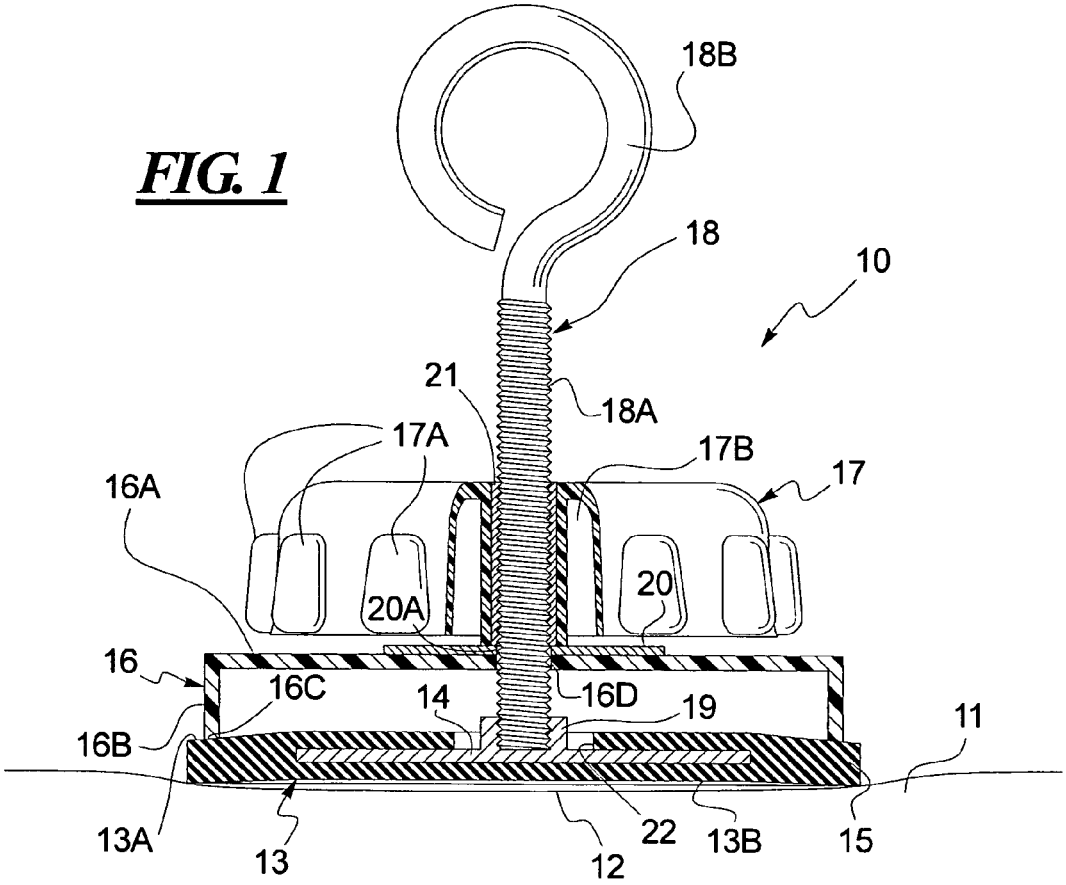
FIG. 1 is a side cross-sectional view taken along line I—I of FIG. 2 showing the improved dent removal device.

For the purposes of promoting an understanding of the principles of the invention, reference will now be made to the preferred embodiment illustrated in the drawings and specific language will be used to describe the same. It will nevertheless be understood that no limitation of the scope of the invention is thereby intended, such alterations and further modifications in the illustrated device, and/or method, and such further applications of the principles of the invention as illustrated therein being contemplated as would normally occur now or in the future to one skilled in the art to which the invention relates.

Figure 2:
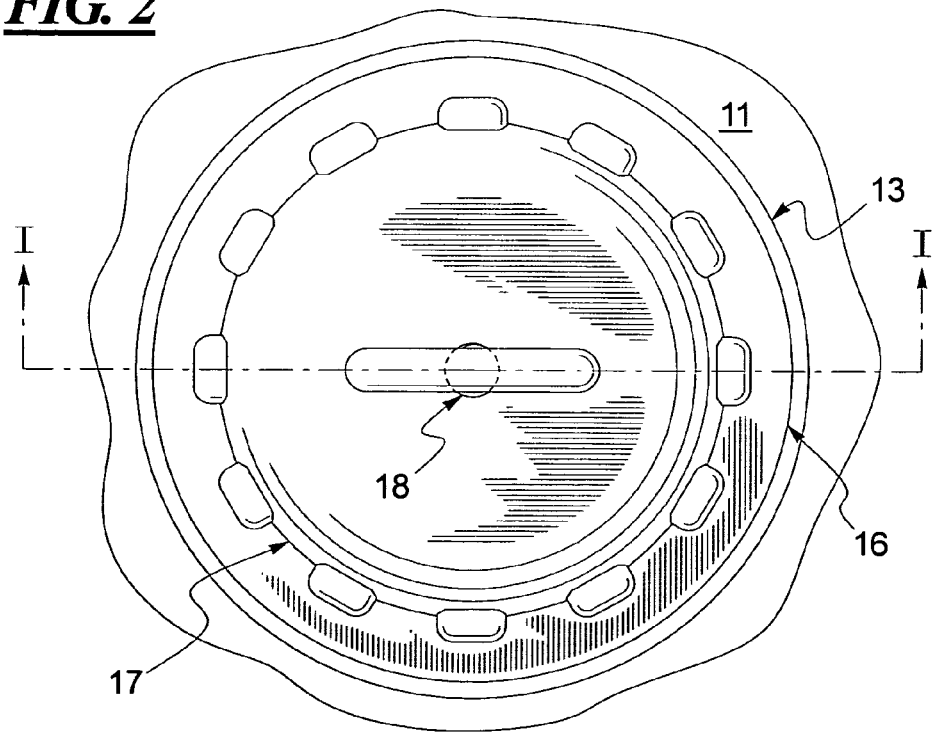
FIG. 2 is a top view of the dent removal device of FIG. 1.

The improved dent removal device is generally shown at 10 in the cross-sectional view of FIG. 1 taken along line I—I of FIG. 2. The dent removal device 10 is placed in a central region of a dent 12 in an automotive vehicle body surface 11. Typically the surface 11 is metal but could be plastic.

The dent removal device 10 has a concave or flat and preferably circular suction element 13 formed of a flexible disc 15 and a support disc 14. The flexible disc 15 is preferably made of rubber and the support disc is preferably made of steel and is round. The support disc 14 is embedded within the flexible disc 15. The flexible disc has a dent facing surface 13B.

An aperture 21, also shown in FIG. 3, is provided at a central region in the upper surface of the flexible disc 15. There a threaded mounting element 19 is fixed to the metal support disc 14 at a central region thereof and within the aperture 22 of the flexible disc. As shown in FIG. 1, the threaded mounting element 19 may be integral with the metal support disc 14, or may be attached, such as by welding.

The mounting element 19 attaches by screw threads to one end of a left-hand threaded pull stud 18 having an elongated stud portion 18A and a pull loop 18B. Opposite the pull loop 18B the end of the stud portion 18A is mounted to the mounting element 19 such as by threading, welding, or other means of fixed attachment. Preferably the pull stud will not rotate relative to the suction element 13 when the device is in use.

A cup-shaped bearing element 16 having a bearing surface 16A and a skirt 16B is arranged to rest on the suction element 13. The peripheral skirt 16B has a bearing edge 16C resting closely adjacent a peripheral edge 13A of the suction element 13. The bearing element 16 also a central aperture 16D through which the pull stud 18 stud portion 18A passes.

A washer 20 having a central aperture 20A is received around the pull stud 18 and rests on the bearing surface 16A.

A suction adjustment knob 17 having projections or nubs 17A on the peripheral surface thereof is provided. The knob has a cavity 17B receiving an embedded nut 22 having screw threads which is screwed onto the stud portion 18A.

FIG. 2 shows a top view of FIG. 1 and shows corresponding elements.

FIG. 3 is a top view of the suction element 13. The element flexible disc 15 has a plurality of apertures 15A–15F preferably arranged in a circular pattern. Also the support disc 14 may have a plurality of apertures 14A, 14B some of which may be one or more of the apertures 15A–15F of the flexible disc. Also as shown in the cross-sectional enlarged view of FIG. 4, projecting portions 15AA of the flexible disc 15 may pass through one or more of the apertures 14A, 14B of the support disc 14.

As shown in FIG. 1, the circular suction element 13 dent facing surface 13B is concave and flexible. When the dent removal device is pressed onto a central portion of the dent 12, it somewhat conforms to the surface portion of the dent where it is placed and, since the vehicle body facing surface 13B as shown in FIG. 1 is continuous without air exits, an increased suction is created by a clockwise screwing of the suction adjustment knob 17, which adjusts the desired suction.

Thereafter, the pull loop 18B is engaged by another lever type device, cable or rope, or is pulled by hand or by any other means to pull out the dent. The knob 17 may then be unscrewed (counterclockwise, for example) to release the suction.

With the dent removal device disclosed, the surface of the dent is undamaged and the dent has been substantially removed.

As shown in FIG. 5, by use of an additional dent removal device 24 positioned at a flat surface portion 25 adjacent to dent 12, a lever 23 may be inserted through loops 18B and 26. By exerting a force 27 on lever 23, the dent 12 may be pulled out.

The dent removal device is convenient to operate, and inexpensive to manufacture.

While a preferred embodiment has been illustrated and described in detail in the drawings and foregoing description, the same is to be considered as illustrative and not restrictive in character, it being understood that only the preferred embodiment has been shown and described and that all changes and modifications that come within the spirit of the invention both now or in the future are desired to be protected.

I claim:

1. A method for removing a dent from an automobile vehicle body surface, comprising the steps of:

providing first and second suction elements each formed of a flexible suction cup disc, a support disc attached to the flexible disc, a pull stud attached to the support disc, a releasable lever engagement member at an end of the pull stud, and a vehicle body facing surface of the flexible suction cup disc being continuous without air exits;

providing a lever;

placing the first and second suction elements in suction contact on the automotive vehicle body surface, at least one of the suction elements being positioned at the dent;

placing the lever in slidable releasable engagement with the releasable lever engagement members of each of the first and second suction elements;

with the lever remaining loosely retained in the releasable lever engagement members, exerting a force on the lever to pull out the dent; and removing the lever from the first and second lever engagement members.

2. A method of claim 1 including the steps of providing a releasable lever engagement member of each suction element as a loop and sliding the lever through both loops for engagement with both loops.

3. A method of claim 2 wherein the pull stud comprises a threaded stud having an end bent around to form said loop, and an opposite threaded end connected by said threading to said support disc.

4. A method of claim 1 including the step of pulling out the dent by pulling at least a portion of said lever away from the vehicle body.

5. A method of claim 1 wherein one of the suction cups is positioned adjacent the dent and the other is positioned at the dent.

6. A method of claim 1 wherein the lever comprises a straight portion.

7. A method of claim 1 including providing the support disc embedded within the flexible disc and providing screw threads on the pull stud engaged with screw threads connected to the support disc.

8. A method of claim 1 including providing for each suction element threads on the respective pull stud, a cup-shaped bearing element having a peripheral skirt abutting the flexible disc, and a suction adjustment knob engaged with the threads of the pull stud and positioned adjacent the bearing element, and after placing the suction elements on the vehicle body surface, rotating the suction adjustment knob of each suction element to achieve a desired suction.

9. A method of claim 8 including the step of unscrewing the respective knobs and then removing the respective first and second suction elements.

10. A method of claim 8 including the step of providing a washer between the knob and a bearing surface of the bearing element.

11. A method of claim 8 wherein the peripheral skirt of the bearing element abuts the flexible disc adjacent a peripheral edge thereof.

12. A method for removing a dent from an automotive vehicle body surface, comprising the steps of:

providing first and second suction elements each formed of a flexible suction cup disc, a support disc embedded inside the flexible disc, a threaded pull stud attached by threads to the support disc, said pull stud being bent at an end opposite said support disc to form an integral loop, and wherein a vehicle body facing surface of the flexible suction cup disc is continuous without air exits;

providing a lever comprising a straight section;

placing the first and second suction elements in suction contact on the automotive vehicle body surface, at least one of the suction elements being positioned at the dent;

sliding the lever straight section through the respective loops of the respective suction elements;

with the lever loosely retained in the loops of the first and second suction elements exerting a pulling force on the lever to pull out the dent; and pulling the lever out from the respective loops of the first and second suction elements.

13. A dent removal system for removing a dent from an automotive vehicle body surface, comprising:

first and second suction elements each formed of a flexible suction cup disc, a support disc attached to the flexible disc, a pull stud attached to the support disc, a releasable lever engagement member at an end of the pull stud, and a vehicle body facing surface of the flexible suction cup disc being continuous without air exits; and a lever releasably and loosely positioned in each of the respective releasable lever engagement members of the first and second suction elements when the first and second suction elements are mounted on the automotive vehicle body surface and with the lever being pulled to remove the dent, at least one of the suction elements being located at the dent.

14. A system of claim 13 including the releasable lever engagement member of each suction element comprising a loop and wherein said lever is slidably and loosely positioned inside the respective loop of each suction element when being pulled to remove the dent.

15. A system of claim 13 wherein the pull stud comprises a threaded stud having an unthreaded end thereof bent to form said loop and an opposite threaded end connected by said threading to said support disc.

16. A system of claim 13 wherein said support disc is embedded inside of the flexible disc.

17. A system of claim 13 wherein the lever comprises an elongate straight section.

18. A system of claim 13 including the support disc being embedded inside the flexible disc and said pull stud having an integral bent loop at one end and screw threads at the opposite end engaged with screw threads of a collar connected to the support disc.

19. A system of claim 13 wherein for each suction element the pull stud has threads, a cup-shaped bearing element having a peripheral skirt which abuts the flexible disc, and a suction adjustment knob is provided and engaged with the threads of the pull stud and positioned adjacent the bearing element.

20. A system of claim 19 wherein a washer is provided between the knob and a bearing surface of the bearing element.

21. A system of claim 19 wherein the peripheral skirt of the bearing element abuts the flexible disc adjacent a peripheral edge thereof.

22. The system of claim 19 wherein said knob has an embedded nut engageable with the threads of the pull stud.

23. A system of claim 19 wherein the threads of the pull stud are left-handed threads so that clockwise rotation of the knob increases suction.

24. A system of claim 19 wherein the knob has projections at a peripheral surface.

25. A system of claim 13 wherein a mounting element attaches an end of the pull stud to the support disc.

26. A system of claim 15 wherein the mounting element is integral with the support disc.

27. A system of claim 25 wherein the mounting element has threads which receive a threaded end of the pull stud.

28. The system of claim 19 wherein the cup-shaped bearing element comprises plastic and the skirt comprises a peripheral skirt spaced less than a quarter inch from a peripheral edge of the suction element.

29. The system of claim 13 wherein the dent facing surface of the suction element is concave prior to placing the suction element on the dent surface.

30. A dent removal system for removing a dent from an automotive vehicle body surface by use of a lever, comprising:

first and second suction elements each comprising a flexible suction cup disc having a vehicle body facing surface which is continuous without air exits, and a support disc attached to the flexible disc; and respective pull studs having one end attached to each of the respective support discs and an opposite end of each pull stud having a loop attached thereto, said loop being dimensioned to allow said lever to freely and loosely pass through and be loosely retained when the lever is being pulled to remove the dent, and so that the lever can be placed between the first and second suction elements when the first and second suction elements are mounted on the automotive vehicle body with at least one of the suction elements being located at said dent.

* * * * *